US007213280B2

(12) United States Patent
Lavin et al.

(10) Patent No.: US 7,213,280 B2
(45) Date of Patent: May 8, 2007

(54) PILLOW

(75) Inventors: Michael P. Lavin, Berkeley, CA (US); Steven Majoros, Oakland, CA (US)

(73) Assignee: Lavin Industries, Inc., Berkeley, CA (US)

( * ) Notice: Subject to any disclaimer, the term of this patent is extended or adjusted under 35 U.S.C. 154(b) by 2 days.

(21) Appl. No.: 11/114,439

(22) Filed: Apr. 26, 2005

(65) Prior Publication Data

US 2006/0236459 A1 Oct. 26, 2006

(51) Int. Cl.
*A47A 27/00* (2006.01)

(52) U.S. Cl. ..... 5/636; 5/630

(58) Field of Classification Search ..... 5/630, 5/636, 639, 730, 740
See application file for complete search history.

(56) References Cited

U.S. PATENT DOCUMENTS 2,700,779 A 2/1955 Tolkowsky
2,898,975 A * 8/1959 Wagner ..... 267/145
3,064,279 A * 11/1962 Finkle ..... 5/636
3,574,873 A * 4/1971 Weinstein ..... 5/655.5
5,088,141 A 2/1992 Meyer et al.
5,160,785 A * 11/1992 Davidson, Jr. ..... 428/316.6
5,528,784 A 6/1996 Painter
5,708,998 A 1/1998 Torbik
6,003,177 A 12/1999 Ferris
6,226,818 B1 5/2001 Rudlick
6,457,195 B1 * 10/2002 Holste ..... 5/636
6,513,179 B1 2/2003 Pan
6,539,568 B2 4/2003 Lee, Jr.
6,574,809 B1 6/2003 Rathbaun
6,629,324 B1 10/2003 Shapiro

* cited by examiner

*Primary Examiner*—Patricia Engle
*Assistant Examiner*—Fredrick Conley
(74) *Attorney, Agent, or Firm*—Clifford A. Poff

(57) ABSTRACT

A pillow with ellipsoidal surface configurations between each of a length and a width of a rectangularly shaped peripheral boundary. An elastic frame provides an internal cavity between sidewalls joined by protruding arcuate corners for receiving an elastically displaced overlying internal mass. This mass is bounded by elongated internal hinged segments terminating at spaced apart parting lines extending in the direction of the length and width of the rectangular pillow boundary.

16 Claims, 6 Drawing Sheets

PILLOW

CROSS-REFERENCE TO RELATED APPLICATIONS

Not applicable

BACKGROUND OF THE INVENTION

1. Field of the Invention

The present invention relates to a pillow construction employed to control a distribution of pressure due to the body weight of a part of a person at rest on the pillow and, more particularly, to such a pillow construction offering the functionally of elastic response to different elastic excursions by the applied pressure of a user's neck and head to consistently maintain a neutral spine alignment of a user in diverse horizontal orientations.

2. Description of the Prior Art

The pillow construction of the present invention maintains the traditional convexly shaped pillow appearance but designed to elastically function in a beneficial manner. FIG. 1 schematically illustrates an individual I in a horizontally orientated, rest position using a conventional pillow P for head and neck support. The pillow is comprised of an elastic mass such as feathers or foamed rubber of which newer materials are foamed latex. The pillow is elastically compressed substantially uniformly along a contact area A1 by the weight of the head H. Compression of the pillow dramatically increases in area A2 underlying the neck N and reaches a maximum compression in area A3 across the area of the shoulder S of the individual because the predominate weight of the shoulder is much greater than that of the head. The pillow compression is greatest under the body weight of the shoulder and as a result there is an over flexion of the neck through an angle $\alpha$. There is also an inward curvature of the shoulders reducing lung capacity by a narrowing of the airway thus increasing the likelihood of apnea because of poor neck support. When the individual rotates 90 degrees in the horizontal rest position, the unit pressure on the pillow is decreased due to the increased surface area of the side facial area combined with the area of the head. The compression of the pillow is reduced thus raising the head to an elevated location relative to the shoulders producing a forward rotation of the upper torso causing a misalignment. There is the lack of a clear airway which reduces the lung capacity. A need therefore exists for an improved pillow construction to overcome these short comings and disadvantages.

The pillow of the present invention is a diversion from prior art pillow constructions that feature a sewn or otherwise permanently shaped resilient mass to provide a preformed pillow configuration. Examples of such prior art pillow constructions are disclosed in U.S. Pat. Nos. 2,700,779; 5,088,141; 5,528,784; 5,708,998; 6,003,177; 6,226,818; 6,513,179; 6,539,568; 6,574,809; and 6,629,324. Such prior art pillow constructions may result in rectangular borders but always an irregular shape to the elastic volume containing the special features of one or more depressed sites relative to other resilient areas usually intended to support or otherwise contact the load bearing area of the user's head and sometimes also the user's neck. The designated specific support site or sites provided by such preformed pillow constructions are usually the cause for a required relative positioning of the pillow and the user. The lack of freedom of movement due to the required fixed positioning of the user relative the pillow can cause fatigue and discomforts in the course of sleep. Additionally, improper support for the user's head and neck may interfere with neutral alignment of the body and promote sleep apnea. The preformed construction of such known pillows also produces a differential to the elevation of support for the head and neck of an individual. Generally, there is a very small if any resiliency to adjust the elevation of support for an individual's head when lying in different horizontal orientations. Preformed pillows also fail to adequately support the head at an elevation to prevent forward rotation of the shoulders thus failing to clear the airway with torsionally misalignment and a reduced lung capacity.

Accordingly, it is an object of the present invention to provide a pillow especially useful for providing support for the head and neck support in a manner designed to maintain the head and body of a person in neutral alignment both laterally and torsionally.

It is a further object of the present invention to provide a pillow especially useful for providing head and neck support and extension for back sleeping while maintaining musculoskeletal support as well as a clear airway.

It is an another object of the present invention to provide a pillow especially useful for providing a head and neck support in a state to maintain ease of respiration and reduce torque on the shoulder.

It is a further object of the present invention to provide a pillow especially useful for providing a head and neck support while maintaining tactility comfort and a luxurious profile.

It is a further object of the present invention to provide a pillow especially useful for providing a head and neck support useful independent of the orientation of the pillow on a support surface.

SUMMARY OF THE INVENTION

According to the present invention, there is provided a pillow with convex surface contours along each of a length and a width of a rectangular shaped elastic pillow body containing an internal cavity defined by spaced apart confronting faces bounded by a peripheral margin formed by cavity side walls, the pillow body including internal hinged segments each underlying a parting line generally overlying one of the cavity side walls for altering elastic compression of the elastic pillow body along the convex surface contours between the spaced apart parting lines in response to elastic excursions into the internal cavity by an applied load of a user's neck and head.

More particularly, the pillow of the present invention comprises a rectangularly shaped elastic pillow body with ellipsoidal surface contours along each of a length and a width divided along a central plane forming divided ellipsoidal parts with plainer faces, and a rectangular shaped elastic spacer having a length and a width corresponding to the length and width of the rectangularly shaped elastic pillow body, the rectangular shaped elastic spacer having a window containing sidewalls with protruding arcuate corners for forming an internal cavity, the divided ellipsoidal parts having elongated internal hinged segments each underlying one of spaced apart parting lines extending in a lengthwise direction of the rectangularly shaped elastic pillow body generally overlying a longitudinal cavity side wall of the internal cavity for varying the compression of the ellipsoidal surface contours transversely of the length thereof between the spaced apart parting lines during elastic excursions into the internal cavity by a user's neck and head.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
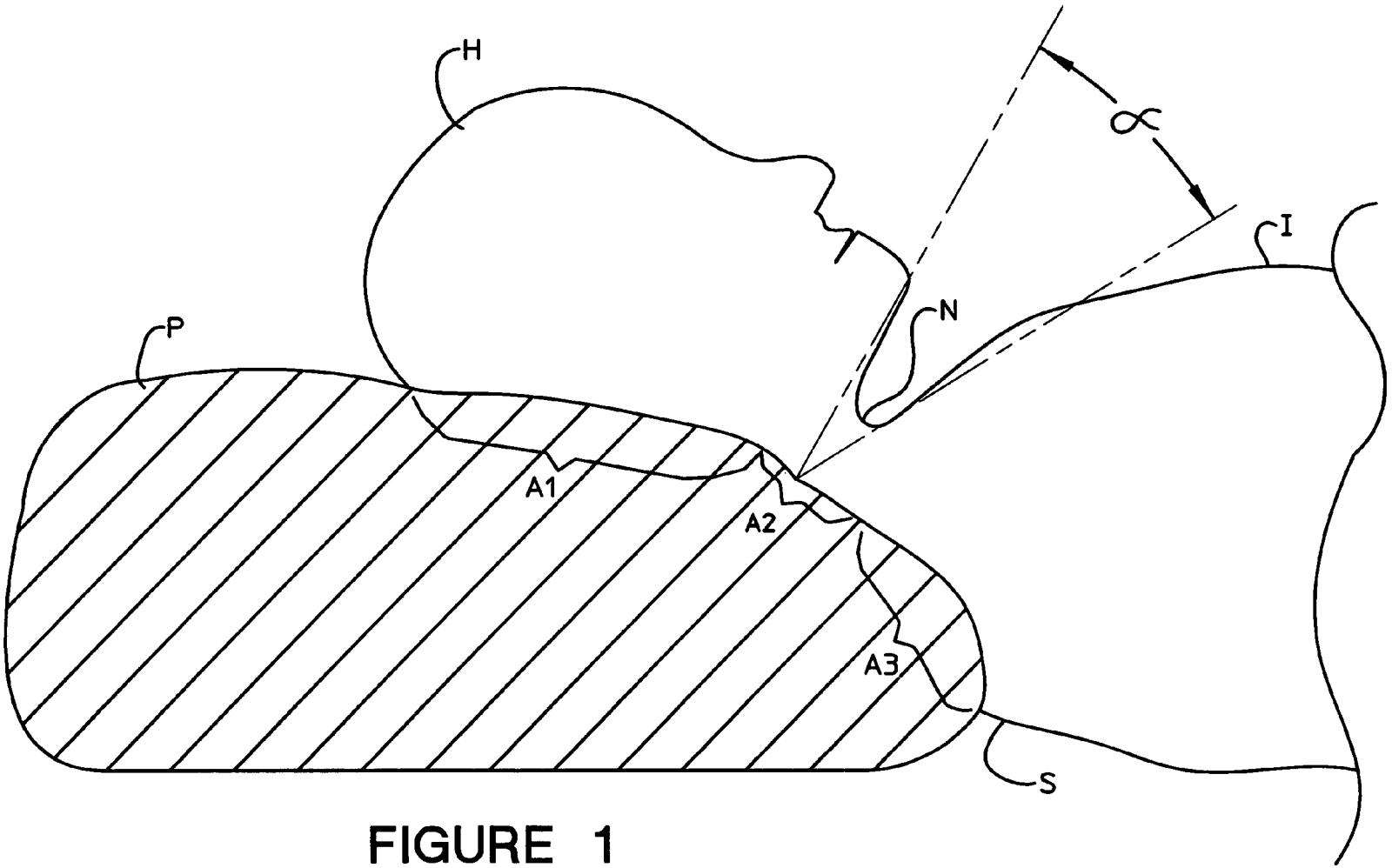
FIGURE 1 PRIOR ART
FIG. 1 is an elevation partly in section illustrating a prior art from of a pillow.
Figure 2:
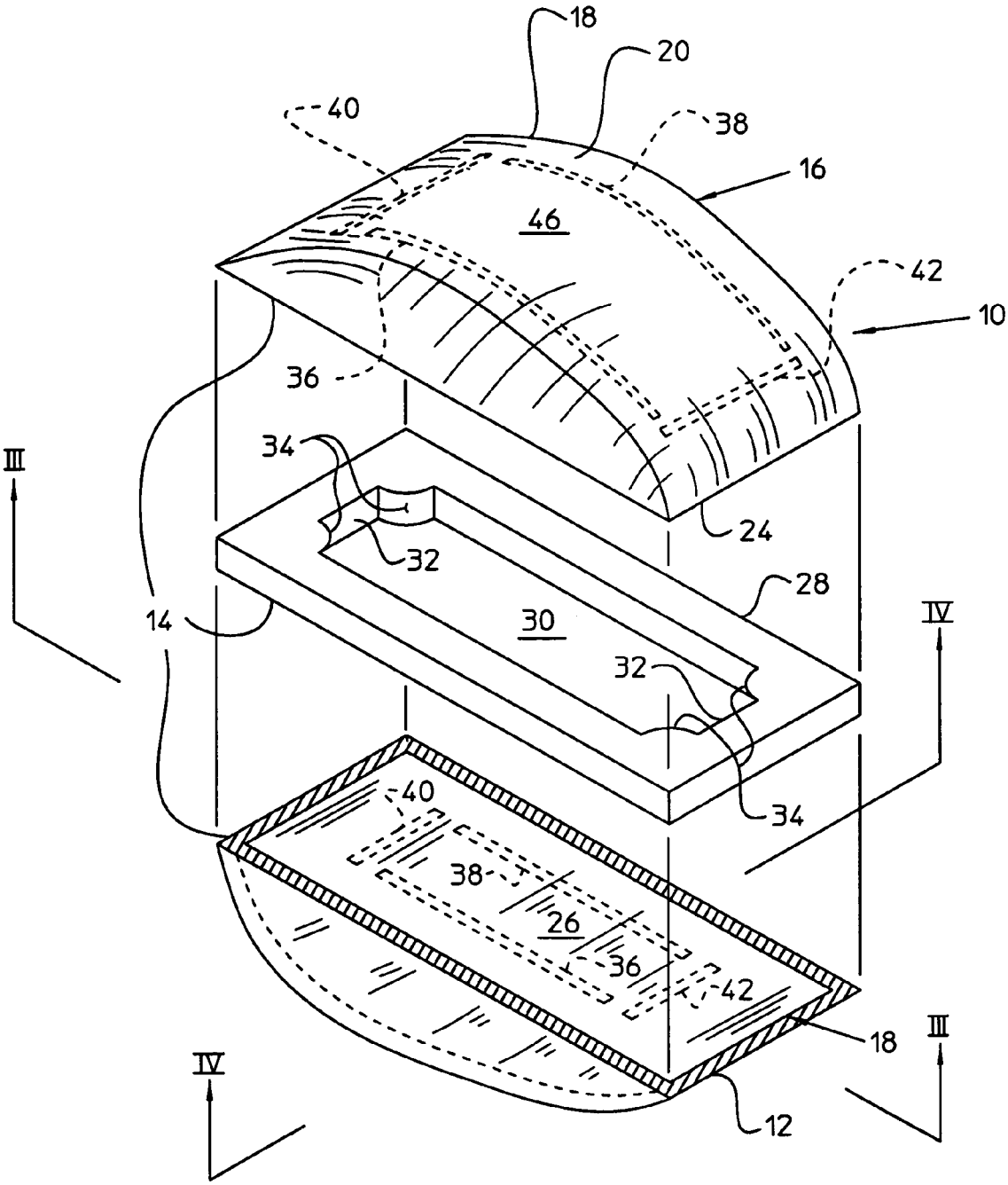
FIG. 2 is an isometric illustration of a first embodiment of an elastic pillow body incorporating the features of the present invention.

In FIG. 2, there is illustrated a pillow 10 according to the first embodiment of the present invention and includes a pillow case 12 suitably dimensioned to receive a rectangular shaped elastic pillow body 14. The pillow body is preferably a molding of expanded latex containing uniformly spaced tubular relief penetrating the entire thickness of the molded mass. The pillow body can take the form of a unitary structure comprised of the construction and arrangement of structure for altering elastic compression of the elastic pillow body along the convex surface contours as will be described in greater detail. The physical properties of the material for producing the pillow case 12 are particularly important to wholly utilize the structured elastically responsive support by the pillow body 14. Also, the elastic response by the pillow body 14 to the applied load is highly dependent on the use of a fabric with elastic properties for constructing the pillow cover to transmit the elastic changes by the pillow to the user. The use of stretch cotton is one suitable material to form the pillow case 12.

Figure 3:
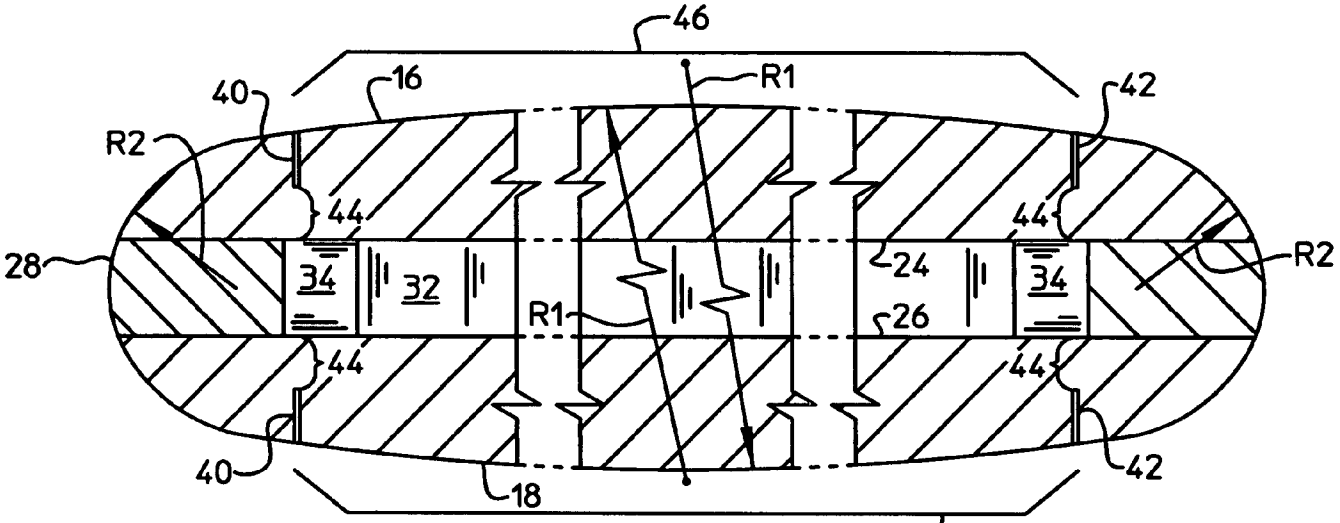
FIG. 3 is a sectional view taken along lines III—III of FIG. 2 illustrating the ellipsoidal configuration along the length of the elastic pillow body.
Figure 4:
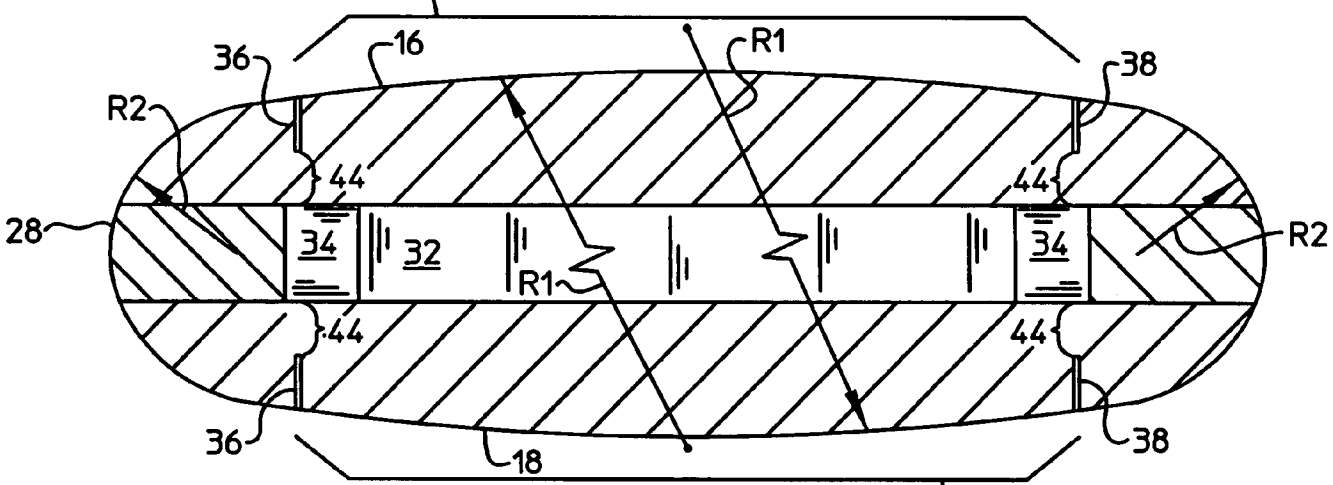
FIG. 4 is a sectional view taken along lines IV—IV of FIG. 2 illustrating the ellipsoidal configuration along the width of the elastic pillow body.

Preferably, and for the purposed of disclosing the preferred embodiment of the present invention, the pillow body 14 is made up of three discrete components, namely face components 16 and 18 having a rectangular, hemi ellipsoidal compression face 20 and 22, respectively, each terminating at one of the generally plainer faces 24 and 26. A rectangular elastic frame 28 contains a window 30 defined by rectangular sidewalls 32 merging at junction areas with protruding actuate corners 34. The planar faces 24 and 26 are adhered to opposite sides of the rectangular elastic frame 28 by the use of a suitable adhesive well known whereby the rectangular, hemi ellipsoidal compression faces 20 and 22 protrude in opposite directions, one of which forms a load bearing surface for contact with the head and neck areas of the user and the other for support by a mattress or other horizontally arranged surface. The present invention allows any of various shaped pillow bodies within a rectangular shaped perimeter. FIGS. 3 and 4 illustrate the geometry applied across the length and width to the pillow for the defining a standard, well known ellipsoidal shape of which the major radii R1 have much greater lengths than the lengths of the minor radii R2. As a result, the pillow exhibits a symmetrical configuration both longitudinal and transverse of the rectangular pillow body which avoids a requirement for turning the pillow to accommodate normal movement of the users head from side to side as well as a need for constant readjustments to the positions of the pillow and the head.

FIGS. 2–4 illustrate further details of construction of the pillow by the provision of spaced apart and parallel longitudinal cut lines 36 and 38 and spaced apart and parallel transverse cut lines 40 and 42 that extend in the direction of the width of the pillow. These cut lines reside in marginal areas spaced inward from the terminal pillow edges to overly but, terminating remote to the rectangular side walls 32 of the rectangular elastic frame 28. The distance 44 separating the cut lines forms an internal, natural hinge linking the central load bearing area 46 of the pillow body bordered by the cut lines and overlying the natural hinges. Area 46 is not only compressible but also the compressed area of the pillow mass is displaceable into the area of the internal cavity 30 and thereby provide a depressed area to maintain displaced head and neck support areas in the pillow body. The cuts lines overlying each hinge function to form a barrier to the propagating elastic compression caused by the forces imposed on the pillow by the body and to reduce the surface tension in the convex surface of the pillow. The decreased surface tension also reduces direct facial contact pressure. The reduction in surface tension provides a more stable contour providing torsionally support as well as a more neutral alignment. The construction of the pillow of the present invention may be dimensioned and shaped the same as a conventional 24"×17"×5" rectangular pillow including the initial tactile response. The support for the head and neck on the pillow is distinct from the an actual physical relief in prior art forms of pillows due to the pillow design responsive to the internal cavity reactive to the cut lines and the natural internal hinges.

Figure 5:
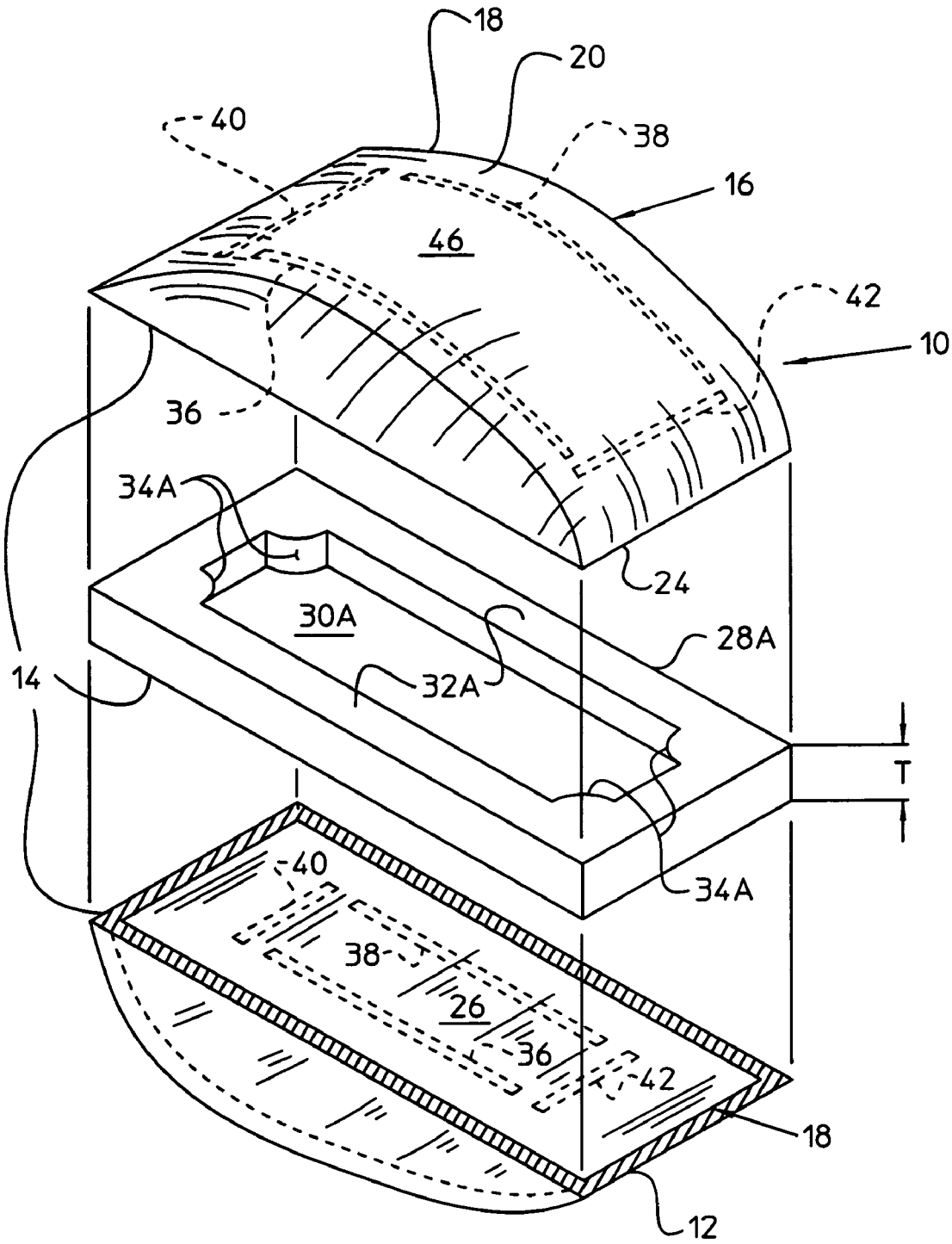
FIG. 5 is an isometric illustration of a second embodiment of the present invention.

FIG. 5 illustrates a further embodiment of the present invention which differs from the embodiment shown in the FIGS. 2–4 essentially by constructing the rectangular elastic frame 28A with the rectangular sidewalls 32A with a thickness T with a materially greater thickness of the sidewalls 32. An illustrative example of the thickness T is a dimension in the range of between two and three inches whereas the thickness of the frame 28 can be in the rang of one an one and one half inches. The volume of the widow 30A is increased for providing added capacity to alter the elastic compression of the elastic pillow body 14A along the convex surface contours between the spaced apart cut lines 36A, 38A, 40A and 42A in response to elastic excursions into the internal cavity by an applied load of a user's neck and head.

Figure 6:
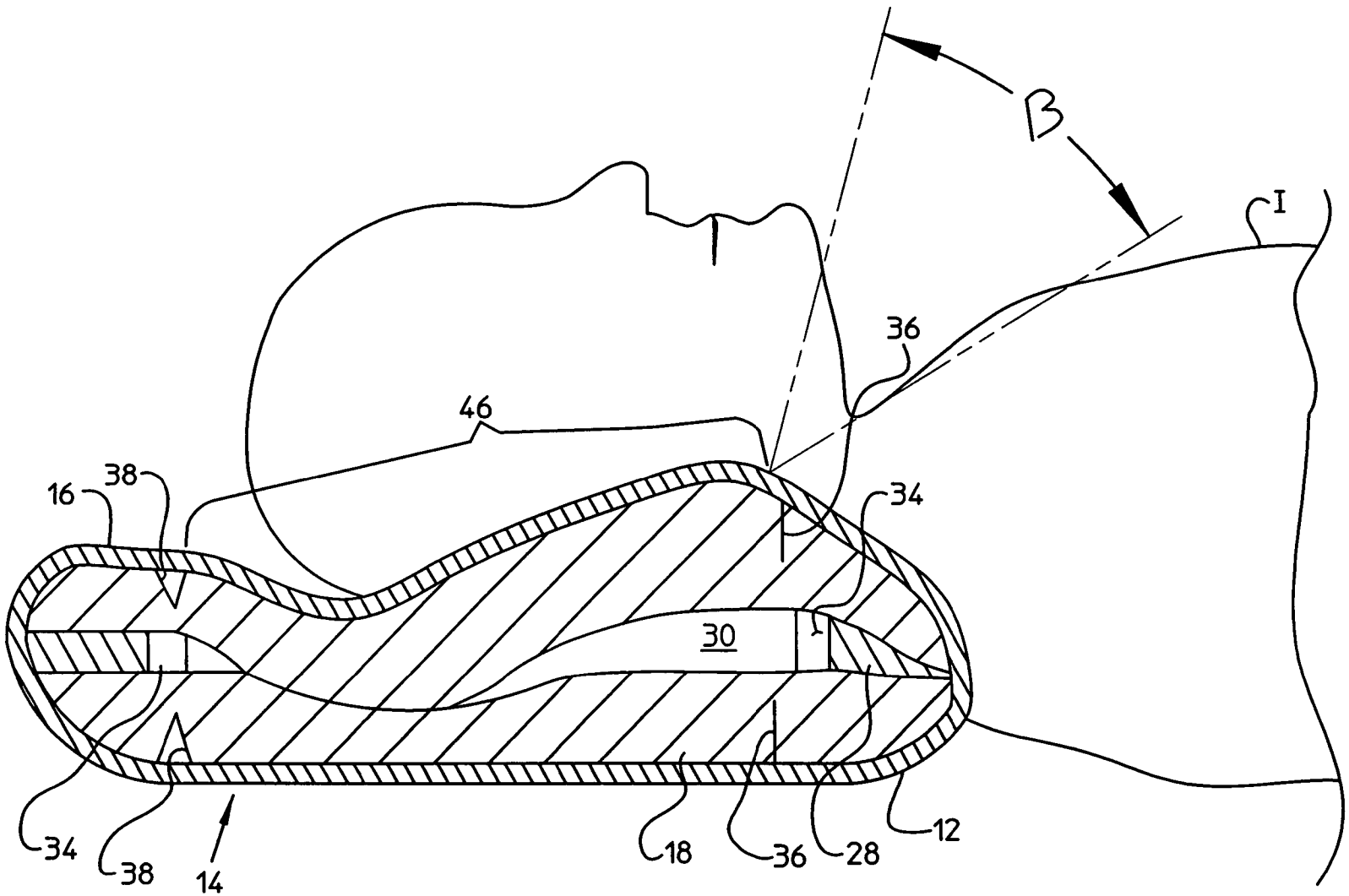
FIG. 6 is a elevation view partly in section illustrating the operation of the pillow according to the present invention.
Figure 7:
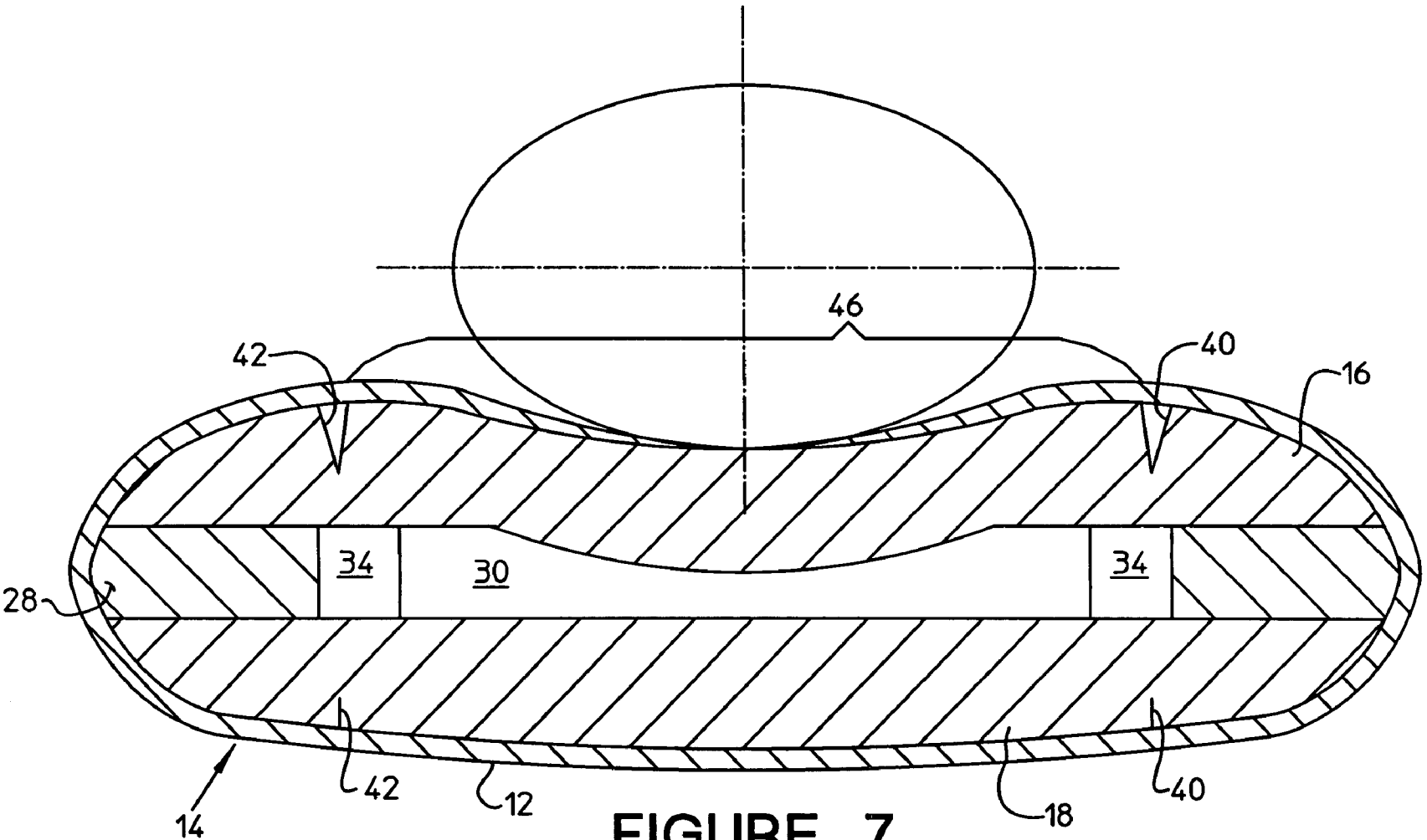
FIG. 7 is a partial sectional view taken along lines VII—VII of FIG. 6.

FIGS. 6 and 7 illustrate the support provided by for the head neck and shoulder of an individual by the pillow of the present invention. FIG. 6 schematically illustrates an individual I in a horizontally orientated, rest position using the pillow 14 for head and neck support. The pillow is elastically compressed to a varying extent as shown along contact area generally comprising the central load bearing area 46. The longitudinal and transverse internal hinged segments 44 each underlying one of parting lines 36, 38, 40 and 42 function to allow an elastic compression of the central load bearing area 46 and elastic displacement of the compressed area into the internal cavity provided by the window 30. The actuate corners 34 provide torsionally stability under the jaw and forehead, especially for people who move forward on the pillow. The cut under the neck seals shut under direct pressure and has no negative function. Only the cut above the head is operational. The parting lines allow for varying the compression of the ellipsoidal surface contours transversely of the length thereof between the spaced apart parting lines by the user's neck and head. Also as shown, the compression of the pillow body in the area of the shoulders is allowed independently by the compression of the pillow by the head preventing flexion of the neck and thereby avoiding restrictions to the airway by maintaining a relaxed extension to the head and neck forming an angle β which clears the airway and provides and expanded lung capacity particularly by the position of the shoulders rearward of the chest cavity. With this sleep posture there is a decreased chance of sleep apnea and reduced likelihood of muscular pressure because of good neck support. When the individual rotates 90 degrees in the horizontal rest position as shown in FIG. 7, the pillow of the present invention undergoes decreased elastic compression thus maintaining the head at an elevation that avoids a torso twisting of the shoulders causing the unwanted forward rotation of the upper torso causing a misalignment produced in a pillow according to prior art. The pillow of the present invention also allows a more accurate conformation of either the rear of the head or the side of the head during side sleeping.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

The invention claimed is:

1. A pillow with convex surface contours along each of a length and a width of a rectangular shaped elastic pillow body with a rectangular elastic spacer having a window containing an internal cavity defined by spaced apart confronting faces bounded by a peripheral margin formed by cavity side walls with protruding arcuate corners, said pillow body including internal hinged segments each underlying a parting line generally overlying one of said cavity side walls for altering elastic compression of said elastic pillow body along said convex surface contours between said spaced apart parting lines in response to elastic excursions into said internal cavity by an applied load of a user's neck and head.

2. The pillow according to claim 1 wherein said spaced apart confronting faces are spaced a distance sufficient to produce a differential to elastic excursions of a peripheral margin surrounding said internal cavity and elastic excursions into said internal cavity between said spaced apart parting lines internal cavity for placing a user's neck and head in a state of relaxed extension.

3. The pillow according to claim 1 wherein said cavity sidewalls are joined by protruding arcuate cavity wall sections for a user's facial jaw support during head and neck in relaxed extension by support on said peripheral margin and elastic excursions into said internal cavity by said ellipsoidal surface configurations between said spaced apart parting lines, respectively.

4. The pillow according to claim 1 wherein said cavity sidewalls are rectangularly arranged with longitudinal sides generally parallel with the length of said rectangularly shaped elastic pillow body.

5. The pillow according to claim 1 wherein said cavity sidewalls have a height sufficient to produce a differential to elastic excursions of a peripheral margin surrounding said internal cavity and elastic excursions into said internal cavity between said spaced apart parting lines for maintaining upper torsional alignment to clear a user's airway.

6. The pillow according to claim 1 wherein said rectangularly shaped elastic pillow body consists of expanded latex with an array of cylindrical relief apertures for substantially linear elastic compression.

7. The pillow according to claim 1 further comprising a fabric cover comprised of stretch cotton enveloping said rectangularly shaped elastic pillow body.

8. A pillow comprising: a rectangularly shaped elastic pillow body with ellipsoidal surface contours along each of a length and a width divided along a central plane forming divided ellipsoidal parts with planar faces; a rectangularly shaped elastic spacer having a length and a width corresponding to the length and width of said rectangularly shaped elastic pillow body, said rectangularly shaped elastic spacer having a window containing sidewalls with protruding arcuate corners for forming an internal cavity; said divided ellipsoidal parts having elongated internal hinged segments each underlying one of spaced apart parting lines extending in a lengthwise direction of said rectangularly shaped elastic pillow body generally overlying a longitudinal cavity side wall of said internal cavity for varying the compression of said ellipsoidal surface contours transversely of the length thereof between said spaced apart parting lines during elastic excursions into said internal cavity by a user's neck and head.

9. The pillow according to claim 8 wherein said divided ellipsoidal parts with planar faces have elongated parallel sides terminating at generally parallel end walls interconnected by corners with sharp radii boundaries.

10. The pillow according to claim 8 wherein at least one of said divided ellipsoidal parts with planar faces contain natural hinges joining a segregated internal mass overlying said rectangular window with side margins to enhance elastic excursions of the segregated internal mass into said internal cavity.

11. The pillow according to claim 8 further including adhesive for joined said divided ellipsoidal parts to said rectangular spacer to form a unitary pillow member.

12. The pillow according to claim 8 wherein said divided ellipsoidal parts consist of expanded latex with an array of cylindrical relief apertures for substantially linear elastic compression perpendicular to said plainer faces.

13. The pillow according to claim 8 further comprising a fabric cover comprised of stretch cotton.

14. The pillow according to claim 8 wherein said spaced includes an elongated rectangular section extending to said window dimensioned for musculoskeletal support of a user.

15. The pillow according to claim 14 wherein said elongated rectangular section and said rectangular window are dimensioned for maintaining a neutral lateral and torsional alignment between the head and body of a user during sleep.

16. The pillow according to claim 8 wherein said rectangular spacer includes peripheral beveled edges.

* * * * *